United States Patent [19]

Aston

[11] Patent Number: 4,475,063

[45] Date of Patent: Oct. 2, 1984

[54] HOLLOW CATHODE APPARATUS

[75] Inventor: Graeme Aston, Montrose, Calif.

[73] Assignee: The United States of America as represented by the Administrator of the National Aeronautics and Space Administration, Washington, D.C.

[21] Appl. No.: 275,909

[22] Filed: Jun. 22, 1981

[51] Int. Cl.[3] ..... H01J 27/02

[52] U.S. Cl. ..... 315/111.81; 315/111.31; 313/131 A; 250/426

[58] Field of Search ..... 315/111.21, 111.31, 315/111.81, 111.91; 250/426; 219/121 P; 313/130, 131 A

[56] References Cited

U.S. PATENT DOCUMENTS

| | | | |
|---|---|---|---|
| 3,253,180 | 5/1966 | Huber | 313/339 |
| 3,523,210 | 8/1970 | Ernstene et al. | 315/111.21 |
| 3,678,334 | 7/1972 | Dugdale et al. | 315/111.81 |
| 3,944,873 | 3/1976 | Franks et al. | 315/111.81 |
| 3,997,756 | 12/1976 | Bykhovsky et al. | 219/121 P |
| 4,060,748 | 11/1977 | Bayless | 313/131 A X |
| 4,264,844 | 4/1981 | Axe et al. | 313/131 A X |
| 4,301,391 | 11/1981 | Seliger et al. | 315/111.31 |
| 4,339,691 | 7/1982 | Morimiya et al. | 315/111.21 |

*Primary Examiner*—Eugene R. LaRoche
*Assistant Examiner*—Vincent De Luca
*Attorney, Agent, or Firm*—Paul F. McCaul; John R. Manning; Thomas H. Jones

[57] ABSTRACT

A hollow cathode apparatus is described, which can be rapidly and reliably started. An ignitor (30) positioned upstream from the hollow cathode (20), generates a puff of plasma (36) that flows with the primary gas to be ionized through the cathode. The plasma puff creates a high voltage breakdown between the downstream end (24) of the cathode and a keeper electrode (32), to heat the cathode to an electron-emitting temperature.

7 Claims, 3 Drawing Figures

FIG. 1
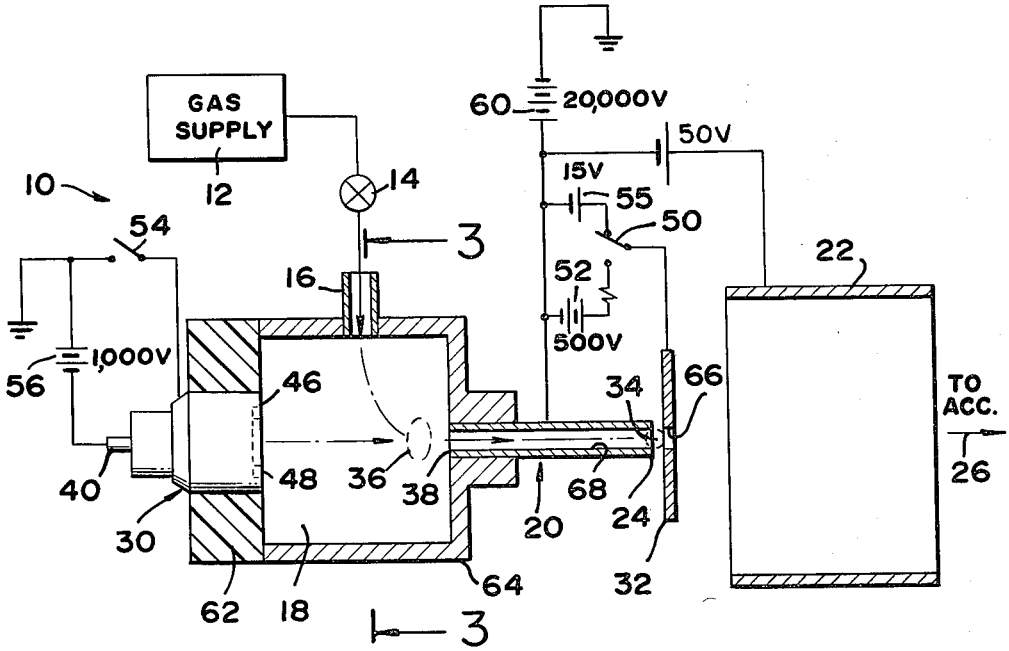
FIG. 2
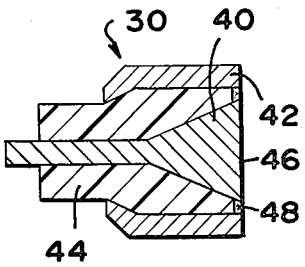
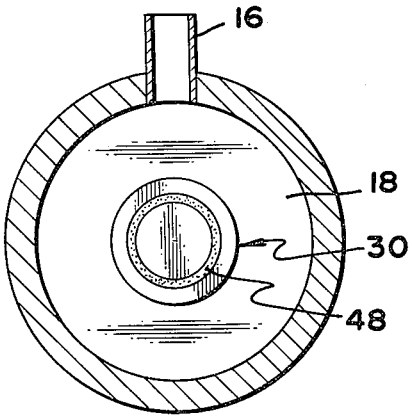
FIG. 3

HOLLOW CATHODE APPARATUS

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

Hollow cathodes are typically in the form of metal tubes through which a primary gas to be ionized can flow, the gas being ionized by electrons emitted within the cathode and accelerated to a downstream anode. One type of hollow cathode utilizes a heater to heat a low work function insert in the cathode to a temperature at which electrons are emitted. Such devices often include a high voltage tickler electrode to start an arc near the cathode end in case the electrons emitted by the low work function insert material are not sufficient to start the arc. Several problems occur with this type of cathode, including a lack of reliable startup, startup times of up to several minutes due to the need to preheat the cathode, the susceptibility to poisioning of the low work function material when it is exposed to air during maintenance, and the possibility of plugging up the cathode by sputtered material generated by the high voltage tickler and insert.

Another common type of hollow cathode, which does not use a low work function insert, employs a radio frequency discharge device for initiating an arc between the cathode and anode to heat the cathode tube to electron emitting temperatures. Although such hollow cathode devices are fairly reliable, they operate at very high input power levels (typically several kilowatts) and cannot be made to operate stably at lower levels such as tens or hundreds of watts. In addition, the radio frequency discharge device adds to the complexity of the hollow cathode device. A hollow cathode device which could start rapidly and reliably, which could operate effectively at moderate power levels, and which was of relatively simple construction, would be of considerable value in a wide range of applications that utilize hollow cathode devices.

SUMMARY OF THE INVENTION

In accordance with one embodiment of the present invention, a hollow cathode apparatus is provided which can be reliably started. The apparatus includes a hollow cathode through which primary gas to be ionized can pass, a keeper electrode slightly spaced from a downstream end of the cathode and at a different potential, and means for flowing a limited quantity of ionized gas into the space between the outer end of the cathode and the keeper to initiate an arc between them. The means for flowing ionized gas can include an igniter that can be electrically energized to create a puff of ionized gas, and which is located upstream from the hollow cathode, so the puff of ionized gas flows with the primary gas through the cathode to its downstream end where the arc is generated.

The novel features of the invention are set forth with particularity in the appended claims. The invention will be best understood from the following description when read in conjunction with the accompanying drawings.

BRIEF DESCRIPTION OF THE DRAWINGS

FIG. 1 is a sectional side view of a hollow cathode apparatus constructed in accordance with the present invention.

FIG. 2 is a sectional view of a portion of the igniter of FIG. 1.

FIG. 3 is a view taken on the line 3—3 of FIG. 1.

DESCRIPTION OF THE PREFERRED EMBODIMENT

FIG. 1 illustrates a hollow cathode apparatus 10 which generates ionized gas that can be utilized for any of a variety of purposes such as in ion engines for space vehicles, for ion implantation in semiconductors, and for neutral beam heating of fusion plasmas. A primary gas supply 12 supplies gas through a valve 14 to an inlet 16 of a chamber 18, to flow the gas into a hollow cathode 20. During steady state operation, the cathode 20 has been heated so that it can emit electrons, and the electrons flow between the cathode and a nearby anode 22 and from the stream of highly ionized gas issuing from the downstream end 24 of the cathode. The electrons ionize the primary gas to generate ions thereof that may be utilized as by passing them in the direction of arrow 26 through an ion accelerator of a prior art type. Once the electrons, or current flow through the cathode has been established to flow electrons to the anode, the electrons emission can be self-sustaining. However, an important problem that is encountered in operating hollow cathode devices, is the initial heating of the cathode to an electron emission temperature to begin the process.

In accordance with the present invention, an igniter 30 is provided which serves to flow a small quantity of ionized gas into the space between the downstream or outer end 24 of the cathode and a keeper electrode or keeper 32. During startup, the keeper 32 is maintained at a moderate voltage such as 500 volts positive with respect to the cathode 20, and is slightly spaced from it. The presence of ionized gas in the space 34 between them, produces an arc between the cathode and keeper. Primary gas flowing into this space feeds the arc and rapidly heats the cathode to emit electrons. The igniter 30 is located to direct the puff of ionized gas, indicated at 36, into the chamber 18, to flow along with the primary gas into the inner or upstream end 38 of the cathode.

The igniter 30, which is shown in greater detail in FIG. 2, includes a pair of terminals 40, 42 which are separated largely by insulation 44. However, at a face 46 of the igniter which faces the chamber, a ring of semiconductor material 48 lies between the terminals. The igniter 30 is largely similar to igniter plugs utilized to start jet engines. When a large voltage is briefly applied between the terminals 40, 42, the current pulse flowing through the semiconductor 48 vaporizes a thin layer of the semiconductor to create a puff of ionized vapor. The large current flowing through the semiconductor also creates a magnetic field which propels the puff of ionized gas directly away from the face 46 of the igniter to propel it into the primary gas stream flowing into the hollow cathode 20. Thus, the igniter generates a small puff of ionized gas and directs it into the hollow cathode, so that the puff quickly finds its way into the space 34 between the cathode end and keeper to initiate the arc.

The hollow cathode apparatus is operated by first opening the valve 14 to begin the flow of primary gas into the chamber 18 and through the hollow cathode 20. A switch 50 is placed in a position to connect a 500 volt voltage supply 52 between the cathode 20 and keeper 32. Then, a switch 54 is closed for a brief period such as one millisecond to connect a 1,000 volt supply 56 to the igniter 30 to produce the puff of plasma 36 and direct it at the cathode 20. The puff 36 moves through the cathode, and when it reaches the space 34 between the cathode and keeper, it initiates the arc. The arc is fed by the primary gas and heats the cathode 20 to continue the emission of electrons. The electrons flowing through the anode 22 ionize the primary gas to create the desired ions. Once the arc is initiated, the cathode-to-keeper voltage can be reduced, as by operating switch 50 to connect a fifteen volt supply 55 between the cathode and keeper.

When the cathode apparatus is operating, the cathode 20 becomes heated, with the outer end 24 visibly glowing and the inner end 38 not quite as hot. By spacing the plug 30 away from the cathode, it is not subjected to such high temperatures, which could vaporize the semiconductor material of the plug. However, the plug is aligned with the hole in the cathode, so that the plasma puff 36 moves directly towards the cathode to provide the highest density of plasma at the space 34 between the cathode and keeper to form an arc.

It is often desirable to maintain the cathode 20 and anode 22 at a high positive potential of more than 1000 volts above ground, to provide a large potential drop to ground potential for accelerating the ions of the primary gas. This can be accomplished by utilizing a voltage source 60. An insulation mount or enclosure wall portion 62 is utilized to insulate the plug from the rest of the enclosure 64 that forms the chamber 18 and that holds the cathode. The insulation mount is utilized because it is important to prevent direct low resistance connection between the outer plug electrode 42 and the enclosure 64 or cathode 20, to prevent the possibility of a destructive continuous arc occurring at the plug face.

In one apparatus that has been constructed with the general configurations shown in FIG. 1, the keeper 32 had a hole 66 of the same size as the hole 68 in the cathode, and was spaced from the cathode by 20 mil (20 thousandths inch). From tests performed with this arrangement, it was found that the hole 68 in the cathode should not be much smaller than about 0.1 inch, in order to assure that the plasma puff 36 can properly propagate through the hollow cathode to reliably start it. Similarly, the keeper orifice 66 should not be much smaller or larger than the cathode inside diameter, as a smaller keeper hole would restrict microplasma movement down the cathode while a larger keeper hole would cause an insufficient voltage field to effect reliable breakdown. While other plasma puff generators could be constructed, the ignitor plug shown at 30 provides highly reliable starting over a large number of cycles. The hollow cathode device described has been utilized to produce continuous arc currents of from two to fifteen amperes utilizing argon as the primary gas.

It should be noted that the apparatus can be utilized primarily for the electrons that are emitted from the cathode, rather than for accelerating the ions. Where the emitted electrons are of primary interest, the voltage source 60 may be eliminated and the cathode grounded.

Thus, the invention provides a hollow cathode apparatus which can be rapidly and reliably started, by using a relatively simple construction. This is accomplished by utilizing a means for flowing a quantity of plasma into the space between a cathode end and adjacent keeper to initiate an arc between them. The plasma can be generated by an ignitor located upstream from the upstream end of the hollow cathode, to produce a plasma puff that passes through the cathode along with the primary gas to initiate the arc. The plug is preferably aligned with the upstream end of the hole in the cathode to enable the propelled puff of plasma to reach the space between the plasma end and adjacent keeper at the highest density of plasma.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. A hollow cathode apparatus comprising:

a cathode having inner and outer ends and having a through hole extending between said ends;

a keeper electrode slightly spaced from said outer end of said cathode;

means for applying an electrical potential between said cathode and keeper electrode;

means for supplying primary gas to flow into said inner end of said cathode hole; and means for flowing a quantity of ionized gas into said inner end of and through said cathode to flow into the space between said outer end of said cathode and said keeper, to initiate an arc.

2. The apparatus described in claim 1 wherein:

said means for supplying primary gas includes walls forming an enclosure having a gas inlet and having an outlet connected to said inner end of said cathode; and said means for flowing ionized gas includes an ignitor having a pair of separated terminals and a seimconductor lying between them, said means for flowing also including means for applying current between said terminals to thereby vaporize some of said semiconductor to form an ionized gas, said semiconductor having a surface facing the inside of said enclosure to flow vaporized semiconductor material with primary gas through said hollow cathode.

3. The apparatus described in claim 2 wherein:

said semiconductor surface is substantially aligned with said through hole of said cathode, whereby to minimize dissipation of the ionized gas.

4. In a hollow cathode structure which includes a hollow cathode with upstream and downstream ends for carrying a gas, a keeper lying adjacent to a downstream end of the cathode to enable the generation of an arc between them, and an anode positioned to attract electrons of the arc, the improvement of apparatus for initiating the arc, comprising:

an igniter which includes anode and cathode terminals and a semiconductor material between, said igniter spaced from the upstream end of the hollow cathode; and means for applying a high voltage pulse between said igniter terminals, to heat and thereby vaporize said semiconductor material to produce a puff of ionized gas, and to produce a magnetic field that propels said puff of gas away from said igniter;

said igniter positioned to direct said puff of ionized gas into said upstream end of said hollow cathode to flow along its inside to the space between said downstream cathode end and said keeper, whereby to provide an ionized gas to initiate the arc.

5. The improvement described in claim 4 including:

walls forming an enclosure with a gas inlet and with an outlet connected to an end of said cathode opposite said keeper; and wherein said igniter is located with said semiconductor material facing the inside of said enclosure.

6. In a hollow cathode apparatus which includes a hollow cathode, a keeper slightly spaced from the downstream end of the cathode and at a higher electrical potential than the cathode, and a source of primary gas to be vaporized for flowing through the cathode, the improvement comprising:

a quantity of semiconductor material spaced from the upstream end of the hollow cathode;

means for applying a current pulse through said semiconductor material to vaporize and ionize it to form a puff of ionized gas; and means for forming an enclosure connected to the upstream end of said hollow cathode;

both said semiconductor and said source of primary gas coupled to said enclosure, to allow the puff of ionized gas from the semiconductor to flow with the primary gas through the hollow cathode, whereby to start and continue to feed a cathode discharge.

7. A method for starting an arc between an end of a hollow cathode and a keeper which is at a higher potential than the cathode, comprising:

generating a quantity of ionized gas and directing it into the other end of and through said hollow cathode toward the space between said cathode and keeper, while also flowing a primary gas to be ionized through said cathode.

* * * * *